United States Patent [19]

Inaba

[11] Patent Number: 4,508,942

[45] Date of Patent: Apr. 2, 1985

[54] KEYBOARD SWITCH

[75] Inventor: Masaichi Inaba, Ibaraki, Japan

[73] Assignee: Nippon Mektron Ltd., Japan

[21] Appl. No.: 555,819

[22] Filed: Nov. 28, 1983

[30] Foreign Application Priority Data

Nov. 30, 1982 [JP] Japan ..... 57-211126

[51] Int. Cl.[3] ..... H01H 13/76

[52] U.S. Cl. ..... 200/5 A; 200/159 B; 200/306

[58] Field of Search ..... 200/5 A, 159 B, 306, 200/8 CR

[56] References Cited

U.S. PATENT DOCUMENTS

| | | | |
|---|---|---|---|
| 4,046,975 | 9/1977 | Seeger, Jr. | 200/306 X |
| 4,322,587 | 3/1982 | Burns et al. | 200/159 B X |
| 4,415,780 | 11/1983 | Daugherty et al. | 200/5 A |

*Primary Examiner*—J. R. Scott

*Attorney, Agent, or Firm*—Fishman & Dionne

[57] ABSTRACT

A membrane keyboard with a circuit means having a plurality of snap action domes formed therein has a cover sheet thereon. A plurality of cavities formed between the cover sheet and the domed circuit layer has air passages connecting each cavity with the ambient environment. The structure of the present invention permits lower tensile force during actuation and results in improved snap action and tactile feel.

10 Claims, 3 Drawing Figures

KEYBOARD SWITCH

BACKGROUND OF THE INVENTION

This invention relates to the field of electrical keyboards. More particularly, this invention relates to the field of membrane keyboards having a plurality of snap action domes which provide tactile feedback to the keyboard operator.

Membrane keyboards of the general type with which this invention is concerned are well known in the art. These keyboards conventionally have a pair of circuit layers, one fixed and one movable, separated by a spacer or separator layer. The circuit layers are sheets of insulating material, with circuit patterns thereon. These circuit patterns face each other and are separated by a spacer, which has apertures at the location of aligned contact elements on the fixed and movable circuit sheets. Typically, one circuit layer will have a plurality of snap action domes formed therein which provide tactile feel or feedback to the keyboard operator. Electrical switching is effected by applying finger or other pressure to specific locations on one of the circuit sheets to move a contact on that circuit sheet through an aperture to make contact with a contact element on a snap action dome of the other circuit sheet whereby the dome inverts thereafter transmitting a snap action to the operator. The fixed and movable circuit layers and the spacer may be separate sheets of material, or any two or three of those sheets may be formed from a single sheet of material folded over in any desired fashion. Keyboards of this configuration are generally formed in a laminate construction with the layers bonded together, sealed or otherwise fixed against relative lateral movement between the layers. The assembly may also include an overlay sheet with indicia of one kind or another to identify key locations and a backer plate to support the assembly.

One disadvantage of a conventional keyboard having snap action domes as described above lies in the quality of desired tactility transmitted to the operator. It has become apparent that the tensile or actuation force which must be exerted on the two circuit layers and insulating spacer during switch operation is very large. As a result, the input pressure and the snap action restoring force are adversely affected. Tactile feedback is generated by the difference between the initial input pressure and the subsequent restorative force. This difference is defined in terms of the snap ratio. In the prior art, both the snap ratio and tactile feel or feedback are particularly adversely affected by the above described conventional structure because the increase in the snap action restoring force is greater than and overrides the increase of the operational pressure.

SUMMARY OF THE INVENTION

The above discussed and other problems of the prior art are overcome or alleviated by the membrane keyboard of the present invention. In accordance with the present invention, a membrane keyboard with a circuit layer having snap action domes formed therein has a cover sheet thereon. A plurality of cavities formed between the cover sheet and domed circuit layer has air passage channels connecting the cavity with the ambient environment.

Because of this novel keyboard structure, the necessary tensile force used during the switch operation arises solely from the exertion of the upper flexible switch sheet. Thus, unlike the prior art, the other constituent members of the keyboard (i.e., other switch sheets and spacer) do not necessitate a tensile force exerted thereon. Thus, the increase in the restoring force is suppressed relative to the prior art resulting in improved snap ratio and tactile feel.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several figures.

DESCRIPTION OF THE PREFERRED EMBODIMENT

Figure 1:
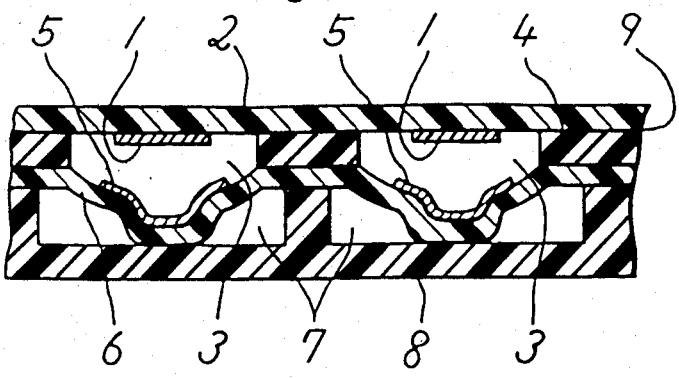
Fig. 1 PRIOR ART
FIG. 1 is a cross sectional elevation view of a membrane keyboard in accordance with the prior art.

Referring first to FIG. 1, a conventional membrane keyboard in accordance with the prior art is shown. The keyboard switch comprises a flexible first circuit layer or switch sheet 2 having a circuit pattern of contact points 1 thereon and an insulating spacer sheet 4 disposed beneath the switch sheet 2. The spacer sheet 4 has a plurality of openings or switch motion cavities formed therethrough which are aligned with the corresponding pattern of contact points 1. A flexible switch sheet 6 having a plurality of snap action domes or protrusions formed therein with a circuit pattern of contact points 5 thereon is positioned beneath the spacer 4. The contact points 5 are aligned with the contact points 1 such that electrical and mechanical contact may be established therebetween upon actuation by the keyboard operator. A rigid support sheet 8 communicates with and supports switch sheet 6 and thereby provides a plurality of cavities 7 which allow room for the dome to snap through upon actuation. Finally, a bonding layer 9 consisting of an adhesive or the like is provided between constituent sheets as shown.

As discussed previously, the above described keyboard suffers certain drawbacks which adversely affects the tactile feedback derived from the snap action domes. A very large tensile force is required to actuate the switch sheet 2, insulating spacer 4 and switch sheet 6 in order to effect mechanical and electrical contact. This large tensile force tends to adversely effect the snap ratio and tactile feedback because the increase in switch restoring force is far greater than the relative increase in input force or operation pressure. Ideally, improved tactile feel or feedback is generated by smaller restoring forces than are provided in the prior art.

Figure 2:
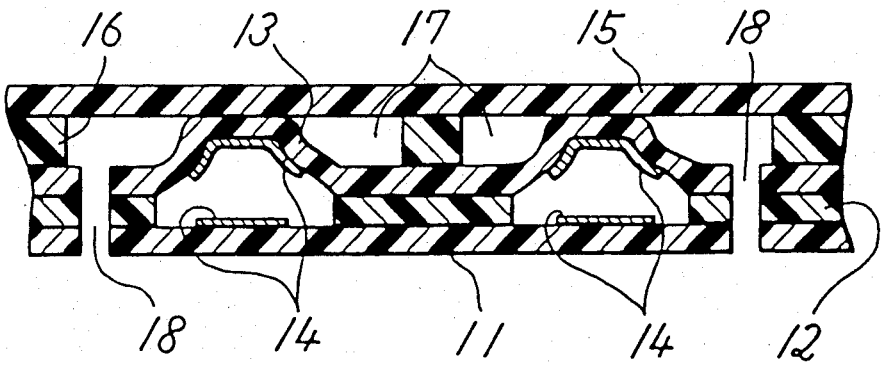
FIG. 2 is a cross sectional elevation view of a membrane keyboard in accordance with the present invention.

The present invention overcomes the above discussed problem by a membrane keyboard structure as shown in FIG. 2. Accordingly, a lower switch sheet 11 is disposed beneath a flexible switch sheet 13 having a plurality of snap action domes or protrusions formed therein, both switch sheets having a circuit pattern of contact points 14 thereon. A first insulating spacer sheet 12 having a plurality of openings or switch motion cavities is provided between switch sheets 11 and 13 so that the openings correspond to the aligned pattern of contact points 14. A flexible cover sheet 15 with a second spacer sheet 16 thereunder is provided above the switch sheet 13 so that cover sheet 15 is planar with the top surfaces of the domes or protrusions. Spacer sheet 16 has a plurality of appropriate cavities 17 which provide open areas for the domes to invert upon actuation thereof. Spacer sheet 16 also acts to support cover sheet 15. A series of air passage channels 18 are also provided which connect cavities 17 to the outside ambient pressure through switch sheets 11 and 13 and first spacer sheet 12.

The novel membrane keyboard structure of the present invention shown in FIG. 2 alleviates the problem related to high tensile forces since the necessary actuation force must only be exerted against cover sheet 15 and not switch sheets 11 and 13 and insulating spacer 12 as was found in the prior art keyboard of FIG. 1. As a direct result thereof, the relative increase of the switch restoring force is suppressed as compared to the prior art with the snap ratio and tactile feedback undergoing a notable and desirable improvement.

Figure 3:
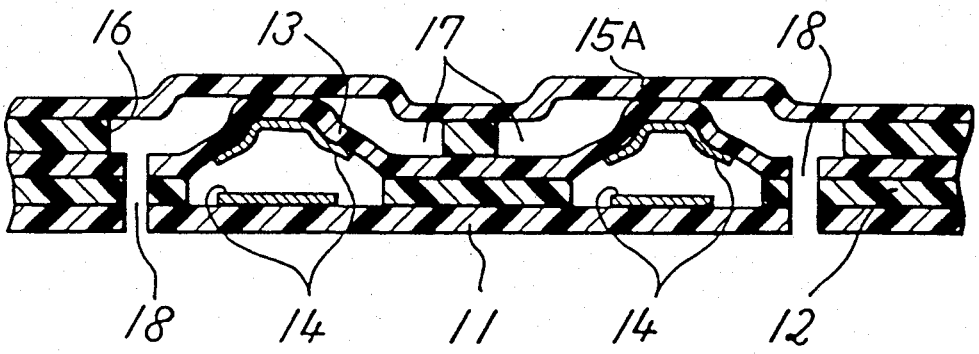
FIG. 3 is a cross sectional elevation view of another embodiment of a membrane keyboard, similar to FIG. 2, but having a corrugated configuration.

Further improvements over the prior art are derived from a second embodiment of the present invention shown in FIG. 3. The membrane keyboard of FIG. 3 is essentially identical to the keyboard of FIG. 2 except that the flexible cover sheet 15A has a corrugated configuration. This corrugated configuration is characterized by a series of stepped-up areas corresponding to the top surfaces of the snap action domes with lower stepped down regions therebetween. This corrugated structure provides even between snap ratio and tactile feel because the curved step portions tend to moderate and more evenly distribute the tensile actuating force.

Moreover, by providing air passages from the cavities 17 to the outside through air passage channels 18, the usually detrimental increase in air pressure upon actuation will be prevented by the free air flow. This increased pressure upon switch operation in a closed membrane keyboard has heretofore adversely affected tactility and snap ratio. The channels 18 of the present invention effectively removes this problem.

The membrane keyboard of the present invention can adequately maintain snap action over long periods of use. The suppressed return and tensile forces provided by the novel structure will act to prevent deterioration of the snap ratio and tactile feedback even after repeated input actuation thereby prolonging the keyboard's operational life. A prolonged life as well as the simplicity of construction provide a more efficient and economical membrane keyboard.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A membrane keyboard including:

first electrical circuit means having a plurality of first switch contacts;

second electrical circuit means having a plurality of second switch contacts corresponding to said first switch contacts, said plurality of first switch contacts being equal to said plurality of second switch contacts;

at least one tactile protrusion formed in said second circuit means, said tactile protrusion projecting out of said second circuit means and away from said first circuit means, said tactile protrusion supporting at least one of said second switch contacts for selective contact with said first switch contacts;

insulating means between said first and second circuit means, said insulating means having at least one opening aligned with said protrusion to permit selective contact between said first and second switch contacts, said opening being hermetically sealed from the ambient environment;

flexible cover sheet means planar with the upper surface of said protrusion, said cover sheet enclosing said second electrical circuit means;

spacer means between said flexible cover sheet means and said second circuit means, said spacer means having at least one cavity surrounding said protrusion; and channel means connecting said spacer means cavity with said ambient environment, said channel means being located through at least said first and second electrical circuit means and said insulating means.

2. A keyboard as in claim 1 wherein said first electrical circuit means includes:

a layer of insulating material with electrically conductive means on one surface thereof facing said second electrical circuit means.

3. A keyboard as in claim 2 wherein said second electrical circuit means includes:

a layer of flexible insulating material with electrically conductive means on one surface thereof facing said first electrical circuit means.

4. A keyboard as in claim 1 wherein:

said cover sheet means has a stepped down planar portion surrounding said protrusion defining a corrugated surface.

5. A keyboard as in claim 1 wherein:

at least a portion of said first electrical circuit means, said second electrical circuit means and said insulating means are in abutting relationship; and wherein:

said channel means is located through said abutting portion of said first and second electrical circuit means and said insulating means.

6. An electric switch including:

first electrical contact means;

second electrical contact means;

at least one tactile protrusion formed in said second contact means, said tactile protrusion projecting out of said second contact means and away from said first contact means, said tactile protrusion supporting said second contact means for selective contact with first contact means;

insulating means between said first and second contact means, said insulating means having at least one opening hermetically sealed from ambient and being aligned with said protrusion to permit selective contact between said first and second contact means;

flexible cover sheet means planar with the upper surface of said protrusion, said cover sheet enclosing said second electrical contact means;

spacer means between said flexible cover sheet means and said second contact means, said spacer means having at least one cavity surrounding said protrusion; and channel means connecting said spacer means cavity with the ambient environment, said channel means being located through at least said first and second electrical contact means and said insulating means.

7. An electric switch as in claim 6 wherein said first electrical contact means includes:

a layer of insulating material with electrically conductive means on one surface thereof facing said second electrical contact means.

8. An electric switch as in claim 7 wherein said second electrical contact means includes:

a layer of flexible insulating material with electrically conductive means on one surface thereof facing said first electrical contact means.

9. An electric switch as in claim 6 wherein:

said cover sheet means has a stepped down planar portion surrounding said protrusion defining a corrugated surface.

10. An electric switch as in claim 6 wherein:

at least a portion of said first electrical contact means, said second electrical contact means and said insulating means are in abutting relationship; and wherein:

said channel means is located through said abutting portion of said first and second electrical contact means and said insulating means.

* * * * *